US005466328A

United States Patent [19]

Nagashima

[11] Patent Number: 5,466,328

[45] Date of Patent: Nov. 14, 1995

[54] RECORDED SHEET PROCESSING UNIT FOR IMAGE FORMING APPARATUS

[75] Inventor: Atsushi Nagashima, Iwatsuki, Japan

[73] Assignee: Fuji Xerox Co., Ltd., Tokyo, Japan

[21] Appl. No.: 113,062

[22] Filed: Aug. 30, 1993

[30] Foreign Application Priority Data

| | | | |
|---|---|---|---|
| Aug. 31, 1992 | [JP] | Japan | 4-255951 |
| Aug. 31, 1992 | [JP] | Japan | 4-255952 |
| Aug. 31, 1992 | [JP] | Japan | 4-255953 |
| Aug. 31, 1992 | [JP] | Japan | 4-255954 |

[51] Int. Cl.[6] ..... B32B 31/00

[52] U.S. Cl. ..... 156/443; 156/457; 156/361; 156/542; 242/535.1

[58] Field of Search ..... 156/443, 446, 156/184, 191, 457, 361, 542; 242/535.1, 595; 271/291, 302, 303

[56] References Cited

U.S. PATENT DOCUMENTS

| | | | |
|---|---|---|---|
| 3,948,505 | 4/1976 | Miller et al. | 271/303 |
| 4,270,968 | 6/1981 | Dudzik et al. | 156/361 |
| 4,712,785 | 12/1987 | Stemmle | 271/291 X |
| 4,784,345 | 11/1988 | Romanowski et al. | 242/535.1 |
| 4,867,437 | 9/1989 | Wise | 271/291 |
| 4,974,784 | 12/1990 | Steidle . | |
| 5,037,037 | 8/1991 | Mayer et al. | 242/535.1 X |
| 5,064,132 | 11/1991 | Merz . | |
| 5,296,908 | 3/1994 | Hatano et al. | 271/303 X |

FOREIGN PATENT DOCUMENTS

| | | |
|---|---|---|
| 0300742A2 | 1/1989 | European Pat. Off. . |
| 63-196462 | 8/1988 | Japan . |
| 1-187133 | 7/1989 | Japan . |
| 1-149363 | 10/1989 | Japan . |

*Primary Examiner*—James Engel

*Attorney, Agent, or Firm*—Finnegan, Henderson, Farabow, Garrett & Dunner

[57] ABSTRACT

A post-processing unit connected to a recorded sheet discharge section of an electronic copying machine, in which a sheet rolling unit forms a recorded sheet as a rolled sheet and seals the rolled sheet by a label or the like so as not to be spread out. Thus, the recorded sheet can be received by a discharge tray in the form of a rolled sheet. In addition, a mechanism for directly discharging the recorded sheet without rolling at the sheet rolling unit is arranged so that short recorded sheets and recorded sheets for which rolling is not specified can be well taken care of. Additionally, in the sheet rolling unit, a discharge guide for directly discharging the recorded paper is provided so that the recorded paper can be received a discharge tray in a condition of an arbitrary surface, front or back, of the recorded sheet facing upward. In addition, the discharging mechanism of the sheet rolling unit is operated in high speed so that the recorded paper can be discharged in high speed even if a distance from the image forming apparatus is short.

11 Claims, 5 Drawing Sheets

RECORDED SHEET PROCESSING UNIT FOR IMAGE FORMING APPARATUS

BACKGROUND OF THE INVENTION

1. Field of the Invention

The invention relates to a post-processing unit disposed at a recorded sheet discharge section of an image forming apparatus such as an electronic copying machine that produces recorded sheets of a large size such as drawings. More particularly, the invention is directed to a recorded sheet processing unit for an image forming apparatus which discharges a recorded sheet formed as a rolled sheet by rolling the long recorded sheet in cylindrical form by a sheet rolling unit and by sealing the rolled sheet while sticking an adhesive tape to the rolled sheet by a sealing means.

2. Description of the Conventional Art

Image forming apparatuses for producing recorded sheets by using electrophotographic systems such as electronic copying machines and laser printers use cut sheets of fixed sizes such as A3 and B4 and employ a means for producing recorded sheets by selecting sheets of an appropriate size in accordance with the size of an original. The electronic copying machine carries, at a sheet feed section thereof, a means which accommodates a plurality of sheet feed trays or sheet feed cassettes, selects a type of sheet based on data such as reduction and enlargement rates, and feeds the selected type of sheets toward an image forming section thereof. The recorded sheets produced by the image forming apparatus are discharged toward a discharge tray or the like after being fixed by a fixing unit.

In addition to the electronic copying machine using sheets of small sizes as described above, image forming apparatuses such as electrophotographic copying machines and plotters used for preparing drawings, recorded sheets are often produced by using sheets of such large sizes as A0 and A1. Let us explain a drawing producing image forming apparatus by taking an electronic copying machine as an example. For example, as disclosed in Japanese Patent Unexamined Publication (Kokai) Hei-1-187133/(1989), an apparatus capable of producing recorded sheets of a large size by setting a wide rolled sheet to the sheet feed section and cutting sheets unrolled from the rolled sheet to a size corresponding to an original is used.

However, such large-sized electronic copying machine can discharge recorded sheets to an arbitrary length, whereas the conventional electronic copying machine discharges a long recorded sheet as being a part of the continuous sheet and piles up the discharged sheet as it is in a receiving member such as a large box. For the long recorded sheet such as described above, it is necessary that an operator stands by the recorded sheet discharge section and "rewind" the long recorded sheet. Therefore, the conventional electronic copying machine must be designed so that recorded sheets be put in order so as not to be scattered around the discharge outlet of the image forming apparatus particularly when the long recorded sheets are to be produced.

In addition to the case where the recorded sheets are produced using an original of such a large size as described above, large-sized electronic copying machines of recent development are designed so that an image forming output unit is combined with a computer to constitute a mechanism for discharging recorded sheets of a large size successively based on image data outputted from the output unit. Further, in an electronic copying machine that produces recorded sheets of a large size by connecting an output unit such as a computer to itself, a plurality of output units may be connected to a single electronic copying machine. Therefore, in the case where recorded sheets are produced in accordance with a recorded sheet producing instruction from an arbitrary output unit, an operator must stand by the electronic copying machine at all times; otherwise the recorded sheets are collected in disorder, making a mess with the recorded sheets of a large size scattered around the electronic copying machine.

To overcome the above problem, a unit for folding a recorded sheet of a large size into a fixed size is used in some cases. A recorded sheet folding unit such as disclosed in Japanese Patent Unexamined Publication (Kokai) Sho-63-196462/(1988) or the like may be used. However, a drawing usually prepared by using a plotter or the like has originality and is often used to check and confirm the design to be referred to for recorded sheets. Therefore, the folding unit such as shown in the conventional example is not preferable, hence imposing the problem with respect to how the recorded sheets of a large size are post-processed.

To overcome this problem, such an arrangement as to facilitate the checking of recorded sheets by disposing a sheet rolling mechanism for a discharge tray for discharging recorded sheets is proposed, e.g., in Japanese Utility Model Publication (Kokai) Hei-1-149363/(1989) instead of using the above-described folding unit. This conventional recorded sheet processing unit can simplify post-processing by disposing the sheet rolling mechanism at an end portion of the discharge tray and keeping a long recorded sheet by rolling in cylindrical form. That is, this unit does not involve the operator for rolling the recorded sheet in the course of copying. However, as described above, this unit requires that recorded sheets be taken out of the discharge tray every time a single recorded sheet is discharged even if the mechanism for automatically rolling long recorded sheets is disposed. In addition, a recorded sheet as rolled may be easy to spread out into a single large sheet if not bound or sealed, etc., thereby imposing the problem as to how such a recorded sheet is kept in order. Further, in the case where recorded sheets of a large size are produced successively, the operator must take care of the long original and cylindrical formed sheets every time a single recorded sheet has been prepared, which is a relatively cumbersome operation.

In addition to the above problem, in the case where recorded sheets are to be produced successively with the image forming apparatus being implemented by a high-speed electrophotographic copying machine or the like, the recorded sheets are discharged from the apparatus close to each other. Therefore, the performance of the image forming apparatus would not be satisfactory unless the post-processing unit has an adequate processing capacity. Further, if the sheet rolling unit is used as the post-processing unit, it is required that the opening and closing member be returned after a rolled sheet has been formed and discharged from the sheet rolling unit and before a next recorded sheet is threaded into the sheet rolling unit. It is for this reason that development of a unit that can meet such requirement has long been needed.

As described above, in the case of arranging the rolled sheet sealing mechanism; e.g., even in the case of arranging a means for sealing with an adhesive tape, it is necessary to make the adhesive tape supplying mechanism simple in structure. A conventional rolled sheet sealing unit employs only a device for rolling the entire circumference of the rolled sheet with the tape. However, the use of such a long adhesive tape entails inconvenience in handling the recorded sheet at the time of unrolling the recorded sheet. Further, the use of such a long tape is disadvantageous in terms of cost and time; the taping operation is time-consuming.

SUMMARY OF THE INVENTION

The invention has been made to overcome the problem of keeping recorded sheets in order in an electronic copying machine for producing recorded sheets of a large size such as described above. Accordingly, the object of the invention is to provide a unit for facilitating post-processing by additionally attaching a post-processing unit to the electronic copying machine and disposing a means for automatically sealing the recorded sheet formed as a rolled sheet so that the recorded sheet accommodated in the discharge tray can maintain the form as a rolled sheet.

Another object of the invention is to provide a unit having a discharge guide so that a recorded sheet not requiring rolling can be discharged directly to a discharge tray and can be guided to the discharge tray with an arbitrary surface of the recorded sheet, front or back, facing upward.

Another object of the invention is to provide a unit that can efficiently perform the processing of recorded sheets discharged from the image forming apparatus close to each other by causing a guide means to return so as to correspond with the operation of rolling a succeeding sheet after the sheet rolling unit has discharged a preceding sheet.

Another object of the invention is to provide a unit that can simplify the sealing mechanism by using a commercially available label as an adhesive tape, which is a means for sealing the rolled sheet, so that the sealing mechanism can be attached to the sheet rolling unit easily.

The invention is applied to a post-processing unit which is connected to an image forming apparatus and which discharges a recorded sheet formed as a rolled sheet, the image forming apparatus producing recorded sheets of a large size by setting a wide rolled sheet of the large size to a sheet feed section thereof and cutting the sheet fed out of the sheet feed section in accordance with a size. The post-processing unit of the invention includes: a sheet rolling unit; a means for discharging a recorded sheet formed as a rolled sheet having a predetermined diameter; and a means for directly discharging a recorded sheet through a sheet guide path of the sheet rolling unit. The sheet rolling unit includes: guide members for guiding the sheet of a large size into a cylinder-like forming section; drive roller members for forwarding the sheet along the guide members; and a sealing mechanism for sticking an adhesive tape or the like to the cylindrically formed sheet. The guide members for guiding the sheet in cylindrical form has a mechanism for discharging a rolled sheet by opening a part of the guide members.

Further, in the recorded sheet processing unit for an image forming apparatus of the invention, the guide members disposed in the sheet rolling unit are formed by combining an upper guide member and a lower guide member, both being semicircular. The upper guide member is arranged at a fixed position and the lower guide member is arranged so as to be opened and closed. A gate member is arranged for the guide members. The gate member forms a recorded sheet as a rolled sheet at such a position as to cause a gate arm of the gate member to extend along a lower portion of the lower guide member. A condition for directly discharging a recorded sheet is set at such a position as to distance the gate arm of the gate member from an upper portion of the lower guide member. The rolled sheet is pushed out of the guide members by a pushing arm disposed on the gate member in association with the operation of opening the lower guide member.

Further, the guide members for guiding the sheet so as to be cylindrical have a mechanism for discharging the rolled sheet by opening a part of the guide members. The discharge section for discharging the recorded sheet toward a discharge tray through the sheet rolling unit has a discharge guide arranged so as to be swingable. The discharge guide has a means for discharging an arbitrary surface, front or back, of the recorded sheet facing upward. Further, in the invention, the discharge guide to be positioned so as to discharge the recorded sheet directly through the sheet rolling unit is arranged so as to be swingable about a shaft member at a discharge outlet. The discharge guide sets a condition so as to discharge the recorded sheet directly when the discharge guide is positioned so as not to block the discharge path. The discharge guide guides the head end of the recorded sheet in a direction of lowering along a vertical plate of the discharge tray when the discharge guide is positioned so as to block the discharge path, whereby the recorded sheet can be received while inverted by holding the front end of the recorded sheet at a joint between the vertical plate and a bottom plate of the discharge tray.

Furthermore, the guide members disposed at the sheet rolling unit are formed by combining an upper guide member and a lower guide member, the upper guide member and the lower guide member being semicircular. The upper guide member is arranged at a fixed position and the lower guide member is arranged so as to be opened and closed. In the invention, the sheet rolling unit further includes a mechanism for discharging a rolled sheet with the lower guide member opened, and the means for opening the lower guide member being driven so that a swing arm for holding the lower guide member is opened immediately after the rolled sheet has been sealed and is then closed until a next recorded sheet is inserted into the sheet rolling unit.

Further, in the invention, the means for opening and closing the lower guide member includes: a wire member connected to an end of the swing arm; a rewind pulley for rewinding the wire member; and a rachet member for holding the swing arm at an elevated position relative to the rewind pulley. The means for opening and closing the lower guide member can constitute a mechanism for causing the ratchet member to return to an operating position after the lower guide member has been opened by releasing a hold condition of the lower guide member relative to the swing arm, and for fixing the lower guide member while returning the lower guide member to a position ready for sheet rolling with the swing arm returned after the wire has been rewound.

In the adhesive tape sticking unit disposed at the post-processing unit of the invention, a means for sensing a tail end of a recorded sheet forwarded toward the guide members is disposed at a predetermined position along a sheet forward path, and a label-like adhesive tape is biased to the tail end of the recorded sheet rolled as a rolled sheet and sealed thereto based on data from the sensing means. Further, in the invention, the means for sticking the adhesive tape to the recorded sheet is implemented by a labeller. The labeller can use a means for sticking a label to a rolled sheet from a label holding base. In addition to the above-described mechanism, the labeller of the invention has a sensing hole between the labels held on the base, and controls a drive mechanism based on data obtained by sensing the hole arranged on the base.

As a result of the above-described recorded sheet processing unit for an image forming apparatus, the electronic copying machine equipped with the post-processing unit of the invention can automatically discharge recorded sheets as rolled even if the long recorded sheets of a large size are to be produced successively, thereby facilitating post-processing after copying. Further, the sheet rolling unit disposed at the post-processing unit senses the tail end of a recorded sheet and seals the recorded sheet by automatically sticking an adhesive tape or the like thereto, which allows the rolled sheet to be unrolled with ease, thereby facilitating the recorded sheets to be kept in order with no handling problem. Still further, the sheet rolling unit can directly discharge those recorded sheets not requiring to be rolled. Therefore, recorded sheets of a relatively small size can be discharged directly toward the discharge tray without being rolled.

Further, the discharge guide is arranged for the discharge outlet for directly discharging a recorded sheet through the sheet rolling unit of the invention. By guiding a recorded sheet with the discharge guide, the recorded sheet can be received in the discharge tray with an arbitrary surface of the recorded sheet, front or back, facing upward, thereby facilitating the handling of recorded sheets. Consequently, the recorded sheet processing unit for the image forming apparatus of the invention can discharge a recorded sheet not only in the formed of a rolled sheet, but also with an arbitrary surface thereof, front or back, facing upward as desired by an operator, thereby facilitating post-processing.

As a result of the above-described recorded sheet processing unit for an image forming apparatus, the electronic copying machine equipped with the post-processing unit of the invention can automatically discharge recorded sheets as rolled even if the long recorded sheets of a large size are to be produced successively, thereby facilitating post-processing after copying. Further, the sheet rolling unit disposed at the post-processing unit senses the tail end of a recorded sheet and seals the recorded sheet by automatically sticking an adhesive tape or the like thereto, which allows the rolled sheet to be unrolled with ease, thereby facilitating the recorded sheets to be kept in order with no handling problem.

Still further, the sheet rolling unit of the invention can forward a preceding recorded sheet at a higher speed in the course of forwarding recorded sheets even if the preceding recorded sheet discharged from the image forming apparatus is forwarded to the post-processing unit close to a succeeding sheet, thereby facilitating the sheet rolling operation. In addition, when the rolled sheet is being discharged, the operation of opening the swing arm and returning the swing arm to the original position can be performed within a short period at the time of discharging the rolled sheet, which allows the guide means to be put in a regular stand-by position before the succeeding recorded sheet reaches the sheet rolling unit, thereby facilitating the sheet rolling operation.

As a result of the above-described recorded sheet processing unit for an image forming apparatus, the electronic copying machine equipped with the post-processing unit of the invention can automatically discharge recorded sheets as rolled even if the long recorded sheets of a large size are to be produced successively, thereby facilitating post-processing after copying. Further, the sheet rolling unit disposed at the post-processing unit senses the tail end of a recorded sheet and seals the recorded sheet by automatically sticking an adhesive tape or the like thereto, which allows the rolled sheet to be unrolled with ease, thereby facilitating the recorded sheets to be kept in order with no handling problem.

Still further, the sheet rolling unit of the invention can employ a mechanism similar to a commercially available labeller. Therefore, by assembling the labeller in the sheet rolling unit that constitutes the post-processing unit, the mechanism of the sealing unit can be simplified. If a hole or the like for sensing the interval between labels on the base holding many labels thereon is arranged, the label forwarding operation can be controlled based on the hole sensing data, thereby allowing the rolled sheet sealing operation to be performed correctly.

DETAILED DESCRIPTION OF THE PREFERRED EMBODIMENTS

Figure 1:
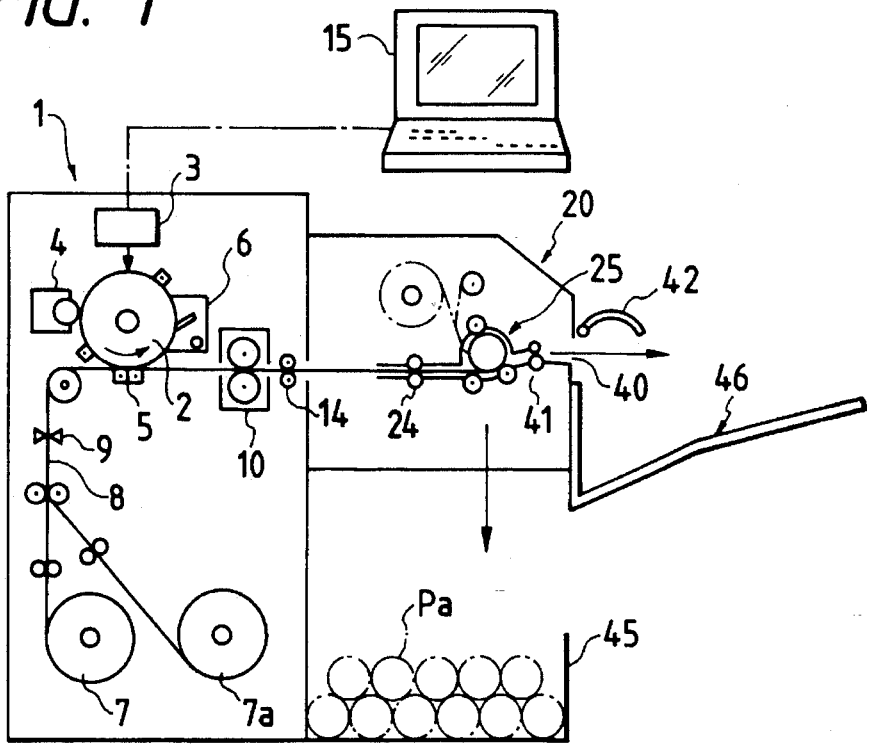
FIG. 1 is a diagram illustrative of an electronic copying machine equipped with a post-processing unit of the invention.

A recorded sheet processing unit for an image forming apparatus of the invention will be described with reference to an embodiment shown in the drawings. FIG. 1 shows an organization of an electronic copying machine 1 and a post-processing unit 20 attached to the electronic copying machine 1 of the invention. To output image data, an output unit 15 such as a computer is connected to the electronic copying machine 1. The output unit 15 outputs digital data, which data is used to write image data to a photosensitive drum 2 using a writing unit 3. The electronic copying machine 1 includes the writing unit 3 for writing data to the photosensitive drum 2 using a laser beam, a developing unit 4, a cleaning unit 6, as well as a transfer corotron 5 that is disposed at the image transfer section of the photosensitive drum.

Similarly with ordinary electrophotographic image forming apparatuses, the electronic copying machine of the invention forms a latent electrostatic image by writing image data to the photosensitive drum, forms a toner image by supplying toner to the latent electrostatic image from the developing unit, and transfers the toner image to a sheet. The sheet to which the toner image has been transferred from the photosensitive drum is subjected to a fixing process at a fixing unit 10 of a thermal roller type, and discharged as a recorded sheet thereafter.

The electronic copying machine 1 can supply a plurality of types of rolled sheets 7, 7*a*, whose size or paper quality is different, to the sheet feed section thereof, forward them along a forward path 8 by unwinding a sheet from either of these rolled sheets, and operate a cutter 9 in accordance with the length data of an image so that the recorded sheet of a desired length can be produced. The sheet feed section can accommodate a plurality of kinds of drawing sheets, such as tracing paper, whose widths are different. The operator can specify the kind or size of a sheet. A sheet forward path is connected to the post-processing unit 20, which is used in combination with the electronic copying machine 1, through a discharge roller 14 on the downstream side of the fixing unit of the electronic copying machine. The post-processing unit 20 has a sheet rolling unit 25, which constitutes a mechanism for automatically rolling a recorded sheet of a large size into a rolled sheet, sealing the rolled sheet, and discharging the rolled sheet toward a discharge tray 45.

Figure 5:
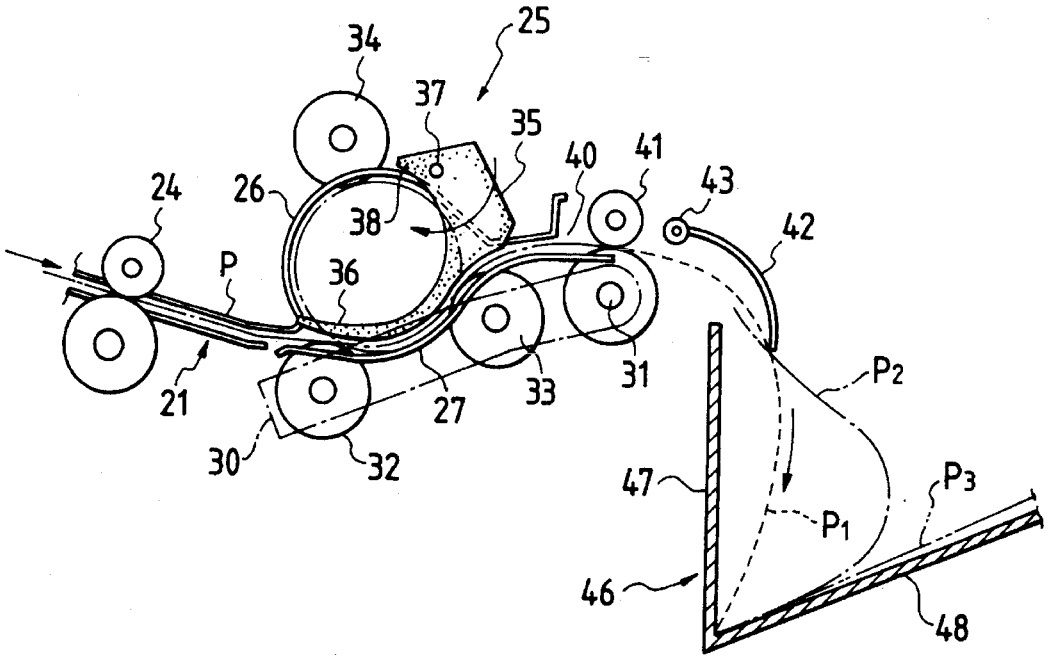
FIG. 5 is a diagram illustrative of a case where a recorded sheet is discharged directly.

Further, the post-processing unit of the invention guides a recorded sheet formed as a rolled sheet by a sheet rolling unit 25 toward a discharge path 40 through a bypass forward path disposed at the sheet rolling unit 25, and forwards the recorded sheet toward a discharge tray 46 through a discharge roller unit 41 disposed at the discharge path 40. As described above, direct discharging of recorded sheets is applied to a case where recorded sheets of a large size are to be discharged with rolling not specified, to a case where copies are to be made by using sheets of a small size, or the like. To effect direct discharging, a discharge guide 42 is disposed at a discharge outlet of the discharge path 40; the discharge guide 42 is supported so as to be swingable about a support shaft 43 and is connected to a not shown drive mechanism through the support shaft 43 so that the discharge guide 42 is swingable as shown in FIG. 5. As shown in FIG. 1, when the discharge guide 42 is stopped when the discharge guide 42 is positioned so as to be swung upward, a recorded sheet is forwarded toward the discharge tray 46 from the discharge path directly and received by the discharge tray 46 with the image formed surface facing upward.

On the other hand, when the discharge guide 42 is lowered to such an extent as to block the discharge path as shown in FIG. 5, the head end of the recorded sheet is forwarded toward a corner portion of the discharge tray, so that the recorded sheets can be piled up in the discharge tray while inverted. An example shown in FIG. 5 indicates a positional relationship among various components when a recorded sheet is guided toward the discharge path 40 through the bypass forward path formed below the sheet rolling unit 25. The operation of forming a rolled sheet by the sheet rolling unit 25 disposed at the post-processing unit will be described in detail later. For those recorded sheets for which rolling is not specified, a controller of the post-processing unit can be instructed so as not to operate the sheet rolling unit, but to perform direct discharging.

To achieve direct discharging, a gate 35 is disposed for the sheet rolling unit 25 as shown in FIG. 5. The gate member 35 is arranged so as to be swingable about a support shaft 37 and has a gate arm 36 projecting at a lower portion of the gate member 35. The gate arm 36 is a very long arm member. The outer surface of the gate arm 36 has the same curvature as the lower semicircular guide 27. A gap is provided between the outer surface of the gate arm 36 and the lower semicircular guide 27 with the gate member being swung, so that a sheet guide path is formed to guide a recorded sheet therebetween.

Further, the discharge guide 42 disposed at the discharge end of the discharge path 40 is, as described above, discharges a recorded sheet toward the discharge tray directly with the image formed surface of the recorded sheet facing upward. In contrast thereto, when the discharge guide 42 is swung to a position shown in FIG. 5 at which the discharge guide 42 blocks the discharge outlet, the recorded sheet is guided downward from the discharge guide 42. As shown in FIG. 5, first, the recorded sheet to be discharged toward the discharge tray 46 gets lowered along a path shown by reference character P1 until the front end of the recorded sheet abuts against the corner portion formed between a vertical plate 47 and a bottom plate 48 of the discharge tray 46. Then, as the recorded sheet is further forwarded by the roller unit, the recorded sheet is sharply bent such as shown by reference character P2 and is piled up along the bottom plate of the tray by its own weight as shown by reference character P3. Therefore, as described above, recorded sheets can be piled up in the discharge tray 46 while correctly paged with their image formed surface facing downward by guiding the recorded sheets by the discharge guide.

Figure 2:
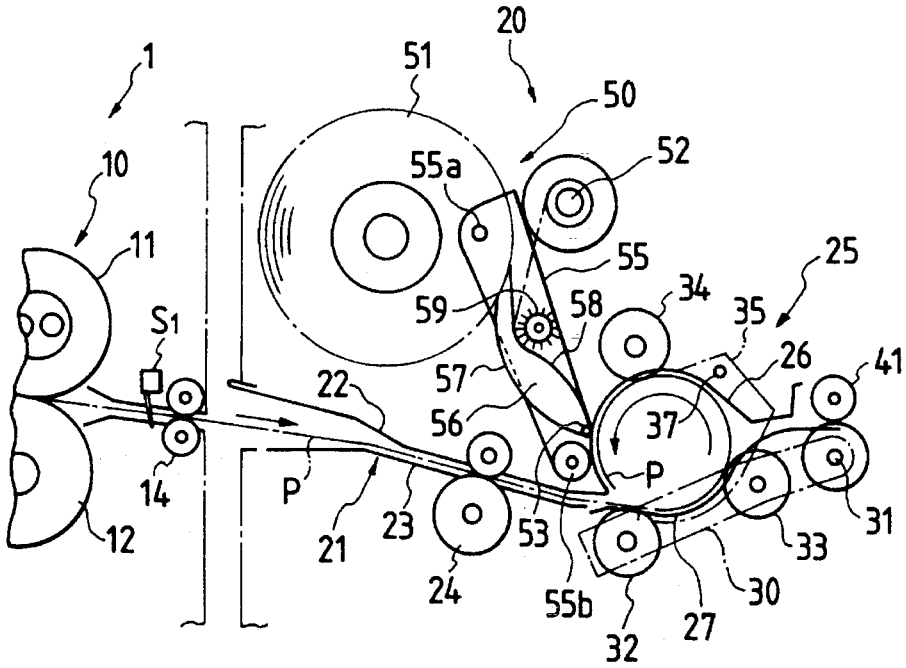
FIG. 2 is a diagram illustrative of an organization of the post-processing unit of the invention.

The post-processing unit 20 has the mechanism for rolling a recorded sheet and sealing the rolled sheet such as shown in FIG. 2. The post-processing unit shown in FIG. 2 includes: a sheet forward path 21 connected to a discharge path of the electronic copying machine; the sheet rolling unit 25 disposed at an end portion of the sheet forward path; and a labeller 50 for sealing a rolled sheet. The sheet forward path 21 shown in FIG. 2 includes: an upper guide plate 22 arranged so as to be opened and closed; and a lower guide plate 23 arranged at a fixed position, so that the sheet forward path extends while interposing a predetermined distance therebetween. A forward roller unit 24 is disposed at a predetermined position along the sheet forward path to be driven at variable speeds. After having detected the tail end of a sheet passing through the fixed unit 10, a preceding sheet is forwarded at a higher speed so that the preceding sheet can be formed into a rolled sheet at the sheet rolling unit and sealed using an adhesive tape member while giving a distance to the succeeding sheet.

The sheet rolling unit 25 disponed at the end of the sheet forward path is formed by combining an upper semicircular guide 26 and a lower semicircular guide 27 in order to guide a recorded sheet so as to be rounded. The upper semicircular guide is disponed at a fixed position and the lower semicircular guide is swingable. Around these guide members of the sheet rolling unit 25 are three drive roller members 32, 33, 34 that are designed to guide the sheet in the bending direction. The roller members 32, 33 out of the three drive roller members are disposed on a swing arm 30. The swing arm 30 is arranged so as to be swingable about a support shaft 31. The swing arm 30 carries, in addition to the roller members, the lower semicircular guide 27, so that the rolled sheet can be dropped while opening the lower half of the sheet rolling unit 25 by swinging the swinging arm 30.

Figure 4:
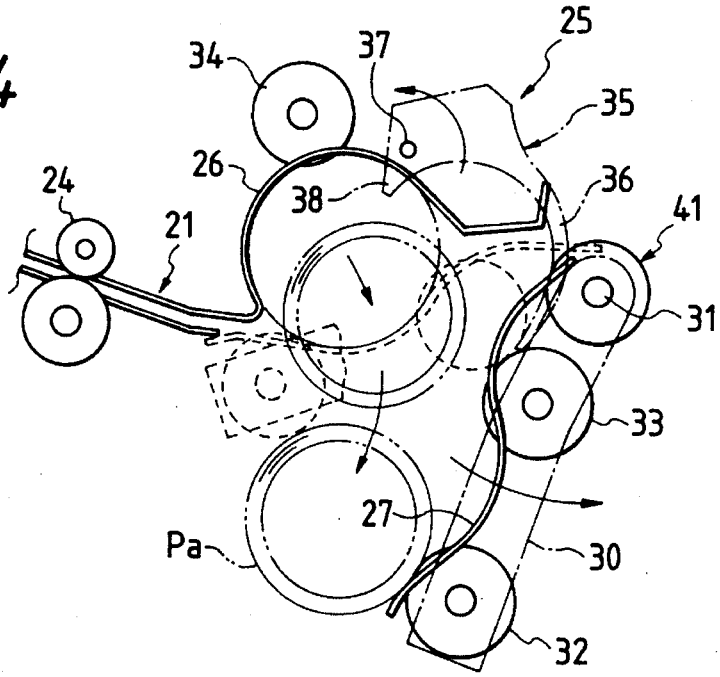
FIG. 4 is a diagram illustrative of the operation of discharging the rolled sheet from the sheet rolling unit.

In addition to the two guide members 26, 27 which are semicircular in section and which forms the guide means, a gate member 35 is arranged in the guide section of the sheet rolling unit 25 of the invention. The gate member 35 is supported at a predetermined position through a support shaft 37 so as to correspond with the upper semicircular guide 26. As shown in FIGS. 4 and 5, the gate member 35 arranges an arm member 36 so as to extend along the lower semicircular guide 27, one side of the arm member 36 being elongate and the other side thereof having a pushing arm 38. When the recorded sheet to be inserted into the sheet rolling unit is formed as a rolled sheet, the gate member 35 is held at a position shown in FIG. 2. On the other hand, when the rolled sheet is to be discharged from the sheet rolling unit 25, the gate member 35 is swung in association with the swing arm 30 and opened to such an extent as shown in FIG. 4. When the gate member 35 has been swung, the pushing arm 38 acts in the direction of pressing the upper portion of the rolled sheet, thereby helping the rolled sheet to be discharged. Further, when the recorded sheet is directly discharged without being specified for rolling, the gate member 35 forms a sheet guide path while swung to a position shown in FIG. 5 and causes the recorded sheet to be discharged through the discharge path.

Figure 3:
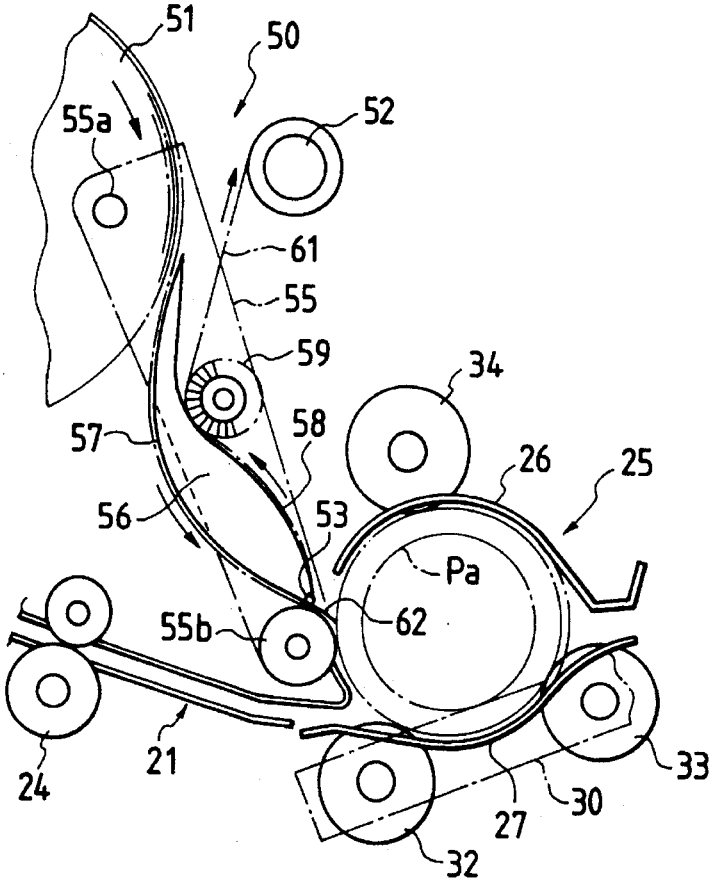
FIG. 3 is a diagram illustrative of a state in which a label is being stuck to a recorded sheet formed as a rolled sheet by a sheet rolling unit.

Further, as shown in FIGS. 2 and 3, the machine of the invention includes a labeller 50 for the sheet rolling unit 25 so that a label supplied by the labeller can be stuck to allow the rolled sheet to be held after the rolled sheet has been formed. The label that is in the form of an adhesive tape member and used as the rolled sheet sealing member of the invention includes commercially available labels whose length is substantially one-half the circumference of the sheet rolling unit 25. The labeller 50 guides a rolled label base supported by a label holder 51 through a guide member 56, so that the rolled label base can be guided toward a rewind shaft 52 through a separating bar 53 disposed at a front end of the guide member. The guide member 56 has a guide surface 57 on the supply side and a guide surface 58 for guiding the board. A forward roll 59 with a plurality of needles projecting is disposed at a predetermined position of the guide surface 58 on the board rewinding side, so that the label board can be forwarded toward the rewind shaft 52.

The labeller 50 is designed so as to allow the rear end of the rolled sheet to be sealed by peeling a label off the label base and sticking the label to the rolled sheet when the long board having labels thereon at a predetermined interval is sharply bent by the separating bar 53. Also, a swing arm 55 is arranged so as to be swingable about a support shaft 55*a*. The swing arm 55 waits at such a position as to be swung clockwise as viewed in FIG. 3, so that the condition is set to cause the separating bar 53 at the lower end of the guide member 56 to bias the rolled sheet only when the label is to be stuck to the rolled sheet.

[Operation of rolling the recorded sheet]

In the thus organized post-processing unit 20 of the invention, when a recorded sheet has been discharged from the electronic copying machine, the head end of such recorded sheet is forwarded toward the sheet rolling unit 25 by the forward roller unit 24 disposed on the sheet forward path 21. The recorded sheet is guided in the rolling direction by a drive roller member projecting inward the cylindrical guides of the sheet rolling unit 25 to start rolling the recorded sheet in cylindrical form. When the tail end of a succeeding sheet discharged from the fixing unit has been sensed by a sensor S1 at the last stage of rolling the preceding sheet at the sheet rolling unit, the forward roller unit 24 disposed at the sheet forward path 21 is driven at a higher speed so that a distance is given to the succeeding sheet forwarded at a predetermined speed. Then, when a predetermined distance has been given between the tail end of the preceding recorded sheet being rolled inside the sheet rolling unit and the head end of the succeeding sheet and before the head end of the succeeding sheet is threaded into the sheet rolling unit, the tail end of the preceding recorded sheet formed as a rolled sheet can be sealed by sticking a tape member thereto.

As the rolling of the preceding sheet has been completed inside the sheet rolling unit 25 in the above-described way and by checking a timing at which the tail end of the preceding sheet having been formed into a rolled sheet inside the sheet rolling unit 25 reaches a label sticking position using the data indicating that the tail end of the succeeding sheet has been sensed, the guide member 56 is swung toward the sheet rolling unit side as shown in FIG. 3. Then, the label base 60 is forwarded by a predetermined distance not only by causing the separating bar 53 to near the surface of the rolled sheet that has been rolled while rotated inside the guide means while swinging the swing arm 55 counterclockwise around the sheet 55*a* in the labeller 50, but also by driving the rewind shaft 52 and the forward roll 59. The label base 60 is sharply bent at the separating bar 53 while being forwarded. As a result, a label 62 held on the label board 60 is peeled off and stuck to the rolled sheet Pa that is rotating inside the sheet rolling unit 25. Further, as described above, the label 62 stuck to the rolled sheet Pa is biased toward the rolled sheet Pa by a biasing roll 55*b* disposed at a lower end of the swing arm 55, so that an end of the rolled sheet can be stuck to and held by the main body thereof.

After the rolled sheet Pa has been formed inside the sheet rolling unit 25 as described above, the rolled sheet Pa is discharged by swinging the swing arm 30 as shown in FIG. 4. The swing arm 30 is supported by the support shaft 31 and has the lower semicircular guide 27. Therefore, when the swing arm 30 is swung counterclockwise through the support shaft 31 as shown in FIG. 4, the lower side of the sheet rolling unit 25 is opened, which causes the rolled sheet Pa accommodated in the sheet rolling unit to drop naturally, losing support. By swinging the gate member 35 counterclockwise through the support shaft 37 following the swinging of the swing arm 30, the pushing arm 38 disposed on the gate member 35 applies such action as to press the rolled sheet from top, thereby assisting the rolled sheet Pa discharging operation.

[Case of directly discharging the recorded sheet]

While a case where the recorded sheet is formed into a rolled sheet has been described in the above embodiment of the invention, a recorded sheet for which rolling is not specified can be discharged directly without involving the operation of the sheet rolling unit. What is employed to achieve such object is the gate member 35 instead of the sheet rolling unit 25 as shown in FIG. 5. The gate member 35 is arranged so as to be swingable about the support shaft 37 and has on the lower portion thereof the gate arm 36 that project. The gate arm 36 is a long arm member. The outer surface of the gate arm 36 has the same curvature as the lower semicircular guide 27. The gate member 35 is swung in such a condition as shown in FIG. 5 in order to set a distance for guiding a sheet between the outer surface of the gate arm 36 and the inner surface of the lower semicircular guide 27, thereby forming a sheet guide path.

As shown in FIG. 5, on the downstream side of the sheet guide path for the sheet rolling unit 25 of the invention are a discharge path 40 and a discharge roller 41. When the nonrolling mode has been specified, a not shown drive mechanism for the gate member 35 is operated to swing the gate member 35 to a position shown in FIG. 5. The recorded sheet forwarded inside the sheet forward path 21 by the forward roller unit 24 is guided to the discharge path 40 while threaded between the gate arm 36 and the lower semicircular guide 27 and is discharged to the outside of the post-processing unit by the discharge roller 41. Under the condition shown in FIG. 5, it is effective to cause the drive roller members 32, 33 disposed at the sheet rolling unit 25 to help the sheet discharge operation by driving such drive roller members.

[Mechanism for swinging the swing arm]

As shown in FIG. 4, the sheet rolling unit 25 of the invention forms a recorded sheet as a rolled sheet and seals the rolled sheet by sticking an adhesive tape thereto. After the rolled sheet has been sealed, the lower semicircular guide 27 is swung downward, so that the rolled sheet inside the sheet rolling unit can be discharged to the discharge tray below the sheet rolling unit. However, the sheet rolling unit receives recorded sheets successively from the image forming apparatus. Therefore, the lower semicircular guide 27 must be returned to a sheet rolling position within a very short period of time before a next recorded sheet arrives at the sheet rolling unit after the rolled sheet has been discharged. The shorter the cycle of the swinging of the swing arm is, the better the performance of the image forming apparatus becomes.

Figure 6:
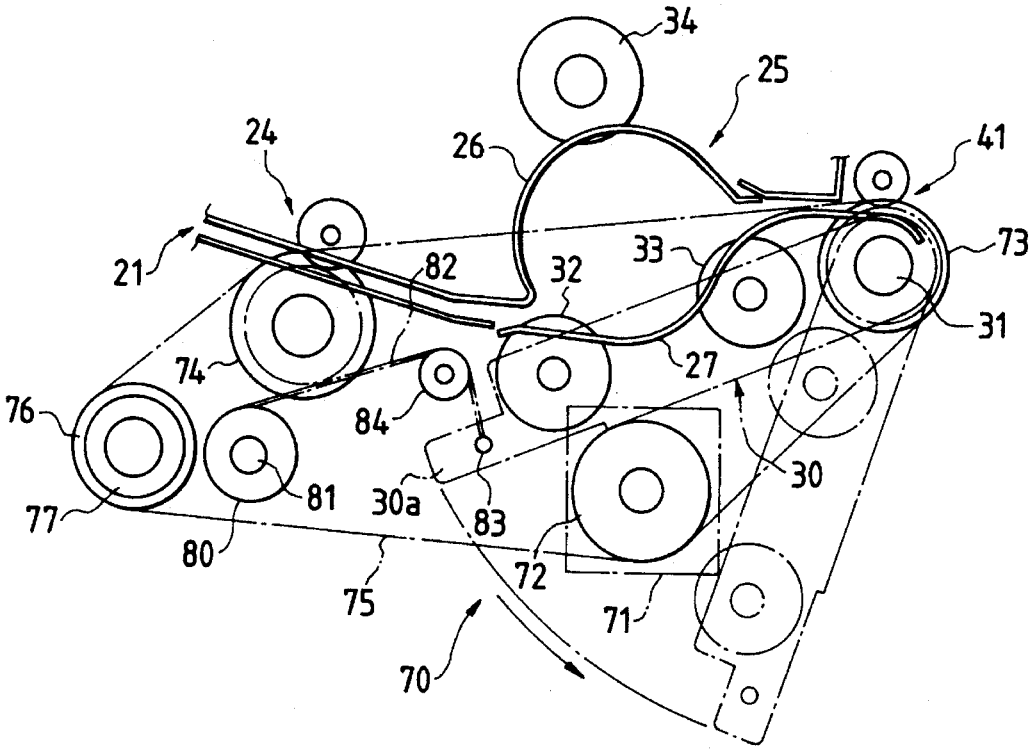
FIG. 6 is a diagram illustrative of an organization of the arm driving unit of the invention.
Figure 7:
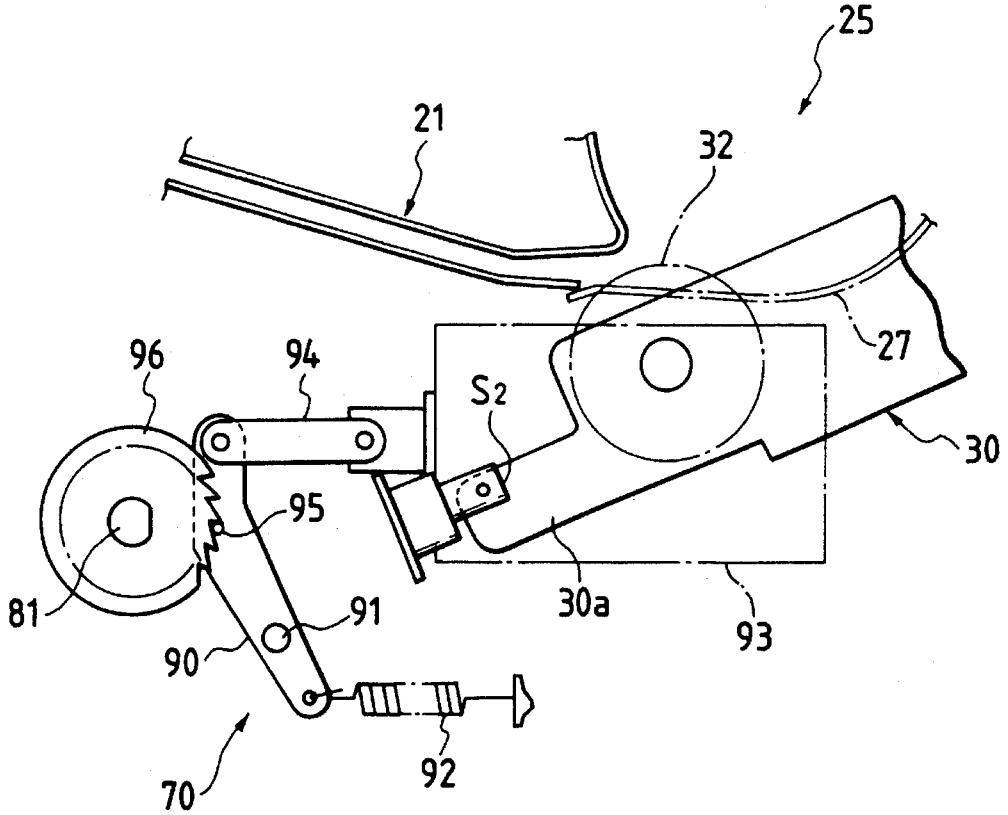
FIG. 7 is a diagram illustrative of a latch mechanism for the swingable arm.

To achieve this object, the sheet rolling unit of the invention has a drive mechanism for the swing arm 30 such as shown in FIGS. 6 and 7. An arm drive unit 70 shown in FIG. 6 includes: a driving sprocket 72 of a motor 71; a sprocket 73 for the discharge roller 41; a sprocket 74 for the forward roller unit 24; and a sprocket 76 for a drive section of the swing arm 30. A chain 75 is installed to these sprockets 72 to 74 and 76 for driving these sprockets. The arm drive unit 70 also drives the drive roller members 32, 33 of the sheet rolling unit through the sprocket for the discharge roller unit 41.

When the tail end of a recorded sheet forwarded along the sheet forward path by the motor 71 is sensed by a sensor, the motor is driven at a higher speed so that the recorded sheet being formed as a rolled sheet inside the sheet rolling unit can be sealed by a label after the lapse of a predetermined time from when the tail end of the recorded sheet has been sensed. At this point, the roller members disposed at the sheet rolling unit are driven at a high speed by the motor 71 to allow the recorded sheet to be rolled and give a large distance from the head end of a succeeding recorded sheet. The sprocket 76 has a clutch 77 so that the clutch 77 can drive a wire rewind pulley 80. A wire 82 to be rewound by the rewind pulley 80 is mounted on a front end portion 30*a* of the swing arm 30. When the wire is loosened by releasing the hold condition thereof with the rewind pulley 80, the swing arm 30 is swung to a position shown by a chain line in FIG. 6 through the support shaft 31 and thereby opens the lower portion of the sheet rolling unit widely, so that a rolled sheet formed at the sheet rolling unit can be dropped.

To control the rewind pulley 80, a drive member such as shown in FIG. 7 is disposed. The drive member for the rewind pulley 80 shown in FIG. 6 includes: a rachet gear 96 disposed on a shaft 81 of the rewind pulley 80; and a rachet pin 95 to be held by teeth of the rachet gear 96. The rachet pin 95 is disposed on a link 90. The link 90 is supported so as to be swingable relative to a shaft 91, connects an arm 94 of a solenoid 93 on the top thereof and a spring 92 on the bottom thereof, so that the link 90 can be swung around the shaft 91 by both members. Further, a sensor S2 is disposed against the front end portion 30*a* of the swing arm 30 to sense the position of the swung arm 30. The arm drive unit 70 of the invention assembling both the drive mechanism and the control mechanism such as shown in FIGS. 6 and 7 is designed to discharge a rolled sheet from the sheet rolling unit and return the swing arm to the original position at a high speed immediately after the discharging operation has been completed, in such a manner as described below.

An operation of the arm drive unit will be described. A recorded sheet forwarded along the sheet forward path is formed into a rolled sheet within the cylinder formed by the upper and lower guide members of the sheet rolling unit 25. When the tail end of the sheet is sensed by a sensor (not shown) in the course of the sheet being rolled, the motor 71 is driven at a higher speed as described above to roll the sheet at such higher speed and then cause the rolled sheet to be sealed by the labeller. At a timing at which the sealing operation has been completed, the solenoid 93 gets energized and the link 90 is swung in the direction of removing the rachet pin 95 from the rachet gear 96. By lowering the swing arm 30 by its own weight while idling the rewind pulley 80, the rolled sheet inside the sheet rolling unit is caused to drop.

The rolled sheet dropping time is set to the controller so that upon lapse of such time, the clutch 77 is turned on. Then, the rewind pulley 80 is driven by the chain to rewind the wire 82. Simultaneously with the timing at which the front end portion 30*a* has been sensed by the sensor S2, the clutch 77 is turned off. If the solenoid 93 that swings the link 90 is turned off simultaneously with the wire rewinding operation or at a predetermined timing, then the rachet pin 95 disposed on the link 90 waits while held by the rachet gear 96. Therefore, a condition for allowing the sheet rolling unit to start sheet rolling again can be set when the rachet pin 95 is held by the rachet gear 96 after the swing arm has been elevated by rewinding the wire and holding the rewind pulley 80.

As described above, even if a biasing force associated with the rolling operation is imparted to the lower semicircular guide 27 in the case where the sheet rolling unit 25 for rolling a recorded sheet is designed so that the lower semicircular guide 27 is swingable relative to the upper guide 26 disposed at a fixed position, reaction of the sheet at the time of rolling can be opposed by the latch mechanism disposed for the swing arm. The swinging unit of the swing arm can open the lower portion of the sheet rolling unit by the weight of the swing arm while turning off the clutch and set the swing arm to the sheet rolling position by elevating the swing arm at a high speed, thereby allowing the sheet discharging process to be performed at the high speed. Further, since a relatively simple arm drive unit operating mechanism can be achieved, the arm drive unit can be operated within a very short period of time before a next recorded sheet reaches the sheet rolling unit.

[Structure of a label cartridge and construction of a labeller unit]

Figure 8:
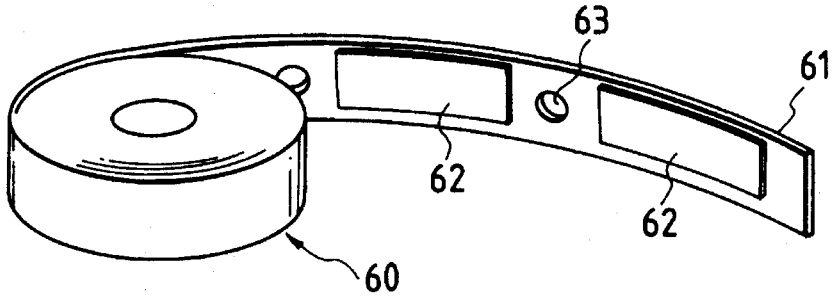
FIG. 8 is a perspective view of a labeller cartridge used in a sealing unit of the invention.

As shown in FIG. 3, the sheet rolling unit 25 of the invention forms a recorded sheet into a rolled sheet and seals the rolled sheet by sticking a label, which is an adhesive tape, by a sealing means. As shown in FIG. 8, a label cartridge 60 serving as the sealing means uses a tape-like long base 61 that supports labels 62, thereon at a predetermined interval. Holes 63 are arranged at a predetermined interval on the base 61, so that the base forwarding operation can be controlled by sensing the holes 63 by a sensor or the like.

Figure 9:
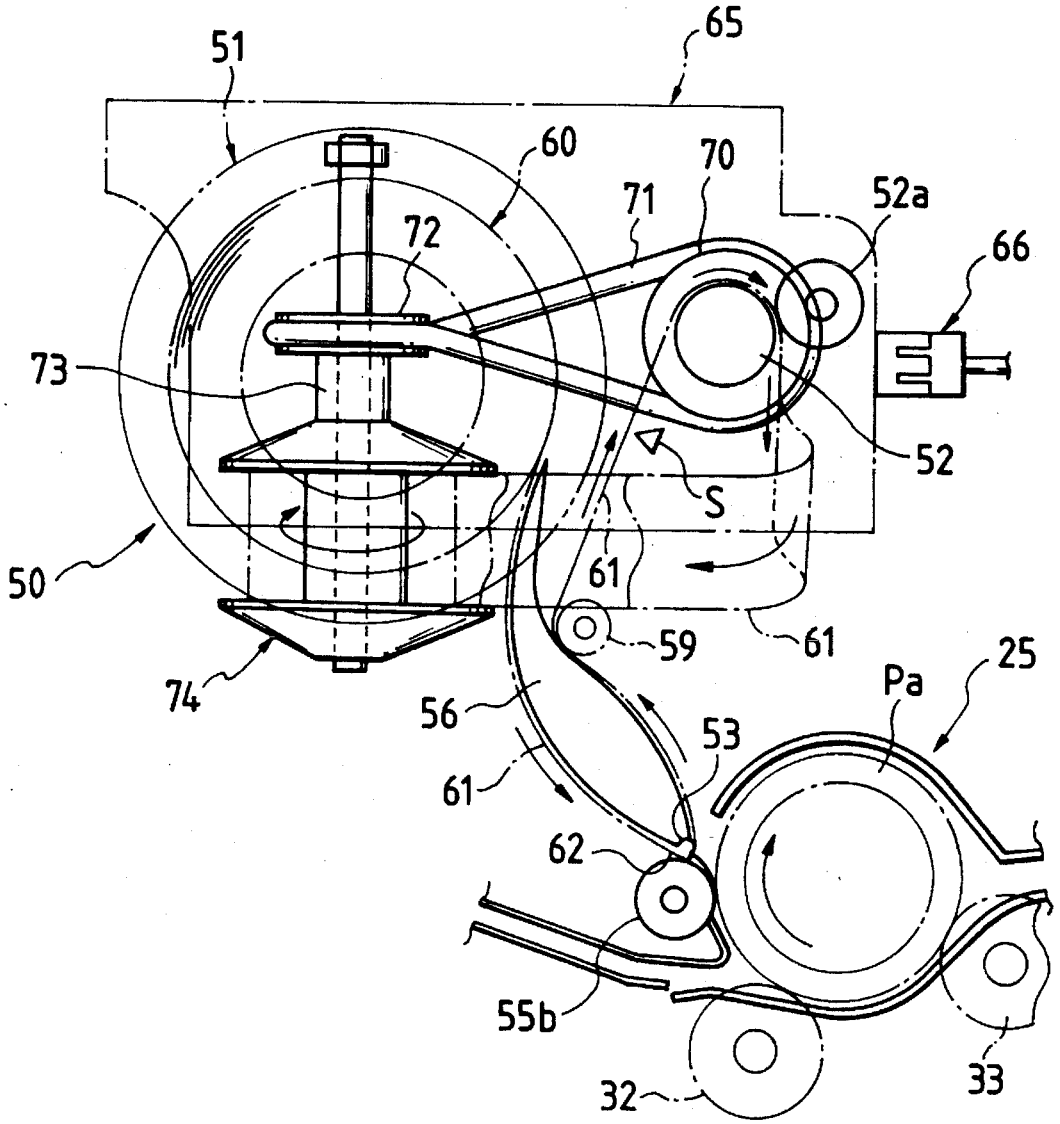
FIG. 9 is a diagram illustrative of an organization of the labeller unit of the invention.

A unit for sealing a rolled sheet by attaching thereto the label cartridge 60 may be implemented as a labeller 50 such as shown in FIG. 9. The labeller 50 shown in FIG. 9 is to be installed to the sheet rolling unit 25, and includes a drive mechanism for supplying labels from the label cartridge 60 and a guide member 56 for sticking a label to a rolled sheet. The mechanism for supplying labels by holding the label cartridge is to be assembled to the sheet rolling unit 25 as a labeller unit 65. The labeller unit 65 is connected to the sheet rolling unit 25 through a connector 66 of the labeller unit 65, so that a signal transmitted through the connector can drive the mechanism for supplying and rewinding the base.

The labeller unit 65 includes: a label holder 51 for supporting the label cartridge 60; a tape forward roll 52 for driving the label holding base so that the base is paid off from the label cartridge 60; and a rewind roll 74 for rewinding the used base. A driven pulley 72 for driving the rewind roll 74 is driven by employing an O-ring-like drive belt 71 between the driven pulley 72 and a drive pulley 70 disposed on a shaft of the tape forward roll 52. The use of the drive belt 71 allows a drive force to be transmitted so as to correspond with the shafts of both pulleys being arranged at right angles to each other.

As shown in FIG. 9, the rewind roll 74 is arranged on a shaft 73 of the driven pulley 72. The used base can be rewound by the rewind roll 74 by driving the rewind roll 74 in association with the tape forward roll 52. As described above, the arrangement that the base supplied from the label cartridge 60 is rewound by the rewind roll disposed on the intersecting shaft is applicable to a case where no sufficient room is provided on an upper portion of the sheet rolling unit. However, if there is sufficient room on the main body of the sheet rolling unit, a mechanism for directly rewinding the base by arranging the rewind roll through a shaft that is parallel with the label holder 51 can be used instead of the mechanism shown in FIG. 9, so that the base can be rewound without being bent.

In the drive mechanism shown in FIG. 9, the label 62 supplied from the label cartridge 60 held on the label holder 51 is stuck to the surface of a recorded sheet while peeled from the base when sharply bent at the separating bar 53 in the course of being forwarded along the guide surface of the guide member 56. The base 61 paid off from the label holder 51 is subjected to an action that forwards the base while biasing the base to the guide surface of the guide member by the forward roll 59 and to an action that forwards the base while nipping the base between the tape forward roll 52 and an idler roll **52*a*. The base 61 forwarded from the nipping section between the tape forward roll 52 and the idler roll 52*a* converts the direction by 90° through a not shown guide member, so that the base is guided toward the rewind roll 74 and rewound in association with the forward operation by the tape forward roll 52**.

When the labeller unit 65 has been set, the labeller of the invention constructed as described above feeds, to a controller of the post-processing unit, data that the connector 66 has been connected, so that the base forward operation can be started. The labeller also sets a condition so that the base is forwarded by a predetermined distance and rewound by the rewind roll while causing a sensor S to sense holes arranged on the base. The hole sensing data is stored in the controller and can be used as data for indicating the remaining number of labels on the base while converted into the length of the base paid off from the label cartridge. After initializing the labeller as described above, sheet rolling is started by the sheet rolling unit.

While the sheet rolling operation is being performed using the labeller, a long recorded sheet inserted into the sheet rolling unit is subjected to a sealing process in the following manner. When the sealing position of the tail end of such recorded sheet has arrived at the sealing means after a predetermined time has elapsed from the application of data indicating that the tail end of such recorded sheet has been sensed to the controller, the lower end portion of the guide member 56 is swung toward the rolled sheet and the base is driven. When the base has been driven, a label is peeled off by the separating bar 53 and biased to the biasing roll **55*b*. As a result, the sealing operation is performed on the recorded sheet. The base is driven while sensing the length of a single label by the sensor. The driving operation of the base is interlocked with the rewinding operation of the used base by the rewind roll 74**.

Therefore, by constituting the base drive mechanism as shown in FIG. 9, the space provided for the labeller can be saved, which facilitates the installation of the labeller to the sheet rolling unit. Further, by using a commercially available labeller, a simple sealing unit design can be achieved, which contributes to a cost reduction in fabricating the sealing unit. The label used for the sealing unit of the invention includes those whose length is about one-half the circumference of a rolled sheet. The label sticking operation is controlled at a timing so that the middle portion of the label is positioned at the tail end of a recorded sheet. Such control allows the sealing of a rolled sheet to be done satisfactorily.

The recorded sheet processing unit for an image forming apparatus of the invention is characterized as described above. Therefore, an electronic copying machine equipped with the post-processing unit of the invention can discharge a recorded sheet automatically as a rolled sheet even if long recorded sheets of a large size are produced successively, thereby facilitating the post-copying operation. Further, the sheet rolling unit disposed on the post-processing unit senses the tail end of a sheet and sticks an adhesive tape or the like automatically to the sheet, which allows the rolled sheet to be unrolled easily, thus imposing no inconvenience in handling sheets and facilitating recorded sheets to be kept in order. Still further, the recorded sheet processing unit for an image forming apparatus of the invention can provide a mechanism for directly discharging recorded sheets for those not requiring the preparation of rolled sheets, thereby allowing recorded sheets whose size is relatively small to be discharged directly to the discharge tray without being subjected to the rolling operation.

Further, the discharge guide is arranged for the discharge outlet for directly discharging a recorded sheet through the sheet rolling unit of the invention. By guiding a recorded sheet with the discharge guide, the recorded sheet can be received in the discharge tray with an arbitrary surface of the recorded sheet, front or back, facing upward, thereby facilitating the handling of recorded sheets. Consequently, the recorded sheet processing unit for the image forming apparatus of the invention can discharge a recorded sheet not only in the formed of a rolled sheet, but also with an arbitrary surface thereof, front or back, facing upward as desired by an operator, thereby facilitating post-processing.

Still further, the sheet rolling unit of the invention can forward a preceding recorded sheet at a higher speed in the course of forwarding recorded sheets even if the preceding recorded sheet discharged from the image forming apparatus is forwarded to the post-processing unit close to a succeeding sheet, thereby facilitating the sheet rolling operation. In addition, when the rolled sheet is being discharged, the operation of opening the swing arm and returning the swing arm to the original position can be performed within a short period at the time of discharging the rolled sheet, which allows the guide means to be put in a regular stand-by position before the succeeding recorded sheet reaches the sheet rolling unit, thereby facilitating the sheet rolling operation.

Still further, the sheet rolling unit of the invention can employ a mechanism similar to a commercially available labeller. Therefore, by assembling the labeller in the sheet rolling unit that constitutes the post-processing unit, the mechanism of the sealing unit can be simplified. If a hole or the like for sensing the interval between labels on the base holding many labels thereon is arranged, the label forwarding operation can be controlled based on the hole sensing data, thereby allowing the rolled sheet sealing operation to be performed correctly.

What is claimed is:

1. A recorded sheet processing unit for an image forming apparatus for producing a large size recorded sheet by setting a wide rolled sheet of the large size to a sheet feed section thereof and cutting the sheet fed out of the sheet feed section in accordance with the size, the recorded sheet processing unit comprising:

a post-processing unit connected to a sheet discharge section of the image forming apparatus, the post-processing unit including:

a sheet rolling unit;

means for discharging a recorded sheet in the form of a rolled sheet having a predetermined diameter; and means for directly discharging an unrolled recorded sheet through a sheet guide path of the sheet rolling unit, the sheet rolling unit including:

guide members for guiding the recorded sheet of a large size, which is to be discharged in the form of a rolled sheet, into a section for rolling the sheet into a cylindrical form and for guiding a recorded sheet which is to be discharged in the form of an unrolled sheet through the sheet guide path, the guide members in the sheet rolling unit are formed by combining an upper guide member and a lower guide member, the upper guide member being arranged at a fixed position and the lower guide member being arranged so as to be opened and closed, the upper guide member and the lower guide member being spaced to make a first opening for receiving the recorded sheet and a second opening for discharging the unrolled sheet when the lower guide member is closed;

drive roller members for forwarding the recorded sheet along the guide members;

a gate member swingable in the sheet rolling unit among a first position, a second position and a third position, the gate member including a gate arm and, when the gate member is placed in the first position and the lower guide member is closed, the gate arm of the gate member is placed across the upper guide member and the lower guide member to block the second opening for preventing the recorded sheet from passing through the second opening and for assisting in forming the rolled sheet, when the gate member is placed in the third position and the lower guide member is closed, the gate arm is placed above the lower guide member for allowing the recorded sheet to pass between the gate arm and the lower guide member and through the second opening, and, when the gate member is placed at the second position and the lower guide member is open, the gate arm is placed away from a path for discharging the rolled sheet and the rolled sheet is pushed out of the guide members by a pushing arm disposed on the gate member; and a sealing mechanism for sticking an adhesive tape to the cylindrically formed sheet, the guide members for guiding the sheet so as to be cylindrical having a mechanism for discharging the rolled sheet by opening a part of the guide members.

2. A recorded sheet processing unit for an image forming apparatus according to claim 1, wherein a discharge tray is placed to receive the unrolled sheet discharged by said directly discharging means, and a discharge guide, swingable between a first and second position, is placed between the directly discharging means and the discharge tray and is effective to discharge the unrolled sheet in an inverted orientation when in said first position and is effective to discharge the unrolled sheet in a non-inverted orientation when in said second position.

3. A recorded sheet processing unit for an image forming apparatus according to claim 2, wherein, if said discharge guide is to discharge the recorded sheet while the recorded sheet is non-inverted, the discharge guide is positioned so as not to block the discharge path, and if said discharge guide is to discharge the recorded sheet while the recorded sheet is inverted, the discharge guide blocks the discharge path to redirect the recorded sheet so that the recorded sheet can be received while inverted in the discharge tray.

4. A recorded sheet processing unit for an image forming apparatus according to claim 1, wherein said guide members are disposed in the sheet rolling unit and are formed by combining an upper guide member and a lower guide member, the upper guide member and the lower guide member being semicircular, the upper guide member being arranged at a fixed position, the lower guide member being arranged so as to be opened and closed, and the sheet rolling unit further includes a mechanism for discharging the rolled sheet with the lower guide member opened, a swing arm for holding the lower guide member and a means for driving the swing arm so that the lower guide member is opened immediately after the rolled sheet has been sealed and is then closed before a next recorded sheet is inserted into the sheet rolling unit.

5. A recorded sheet processing unit for an image forming apparatus according to claim 1, wherein the sealing mechanism includes:

means for sensing, at a predetermined position along a sheet forward path, a tail end of a recorded sheet forwarded toward the guide members, and means for sealing the tail end of the recorded sheet rolled as a rolled sheet based on data from the sensing means.

6. A recorded sheet processing unit for an image forming apparatus according to claim 5, wherein the sealing mechanism is implemented by a labeller, the labeller using a means for sticking a label to a rolled sheet from a label holding base.

7. A recorded sheet processing unit for an image forming apparatus according to claim 6, wherein the labeller senses a hole between the labels held on the label holding base, and controls a drive mechanism based on the sensed hole arranged on the labels held on the label holding base.

8. A recorded sheet processing unit for an image forming apparatus for producing a large size recorded sheet by setting a wide rolled sheet of the large size to a sheet feed section thereof and cutting the sheet fed out of the sheet feed section in accordance with the size, the recorded sheet processing unit comprising:

a post-processing unit connected to a sheet discharge section of the image forming apparatus, the post-processing unit including:

a sheet rolling unit;

means for discharging a recorded sheet in the form of a rolled sheet having a predetermined diameter; and means for directly discharging an unrolled recorded sheet through a sheet guide path of the sheet rolling unit, the sheet rolling unit including:

guide members for guiding the recorded sheet of a large size, which is to be discharged in the form of a rolled sheet, into a section for rolling the sheet into a cylindrical form and for guiding a recorded sheet which is to be discharged in the form of an unrolled sheet through the sheet guide path, said guide members are disposed in the sheet rolling unit and are formed by combining an upper guide member and a lower guide member, the upper guide member and the lower guide member being semicircular, the upper guide member being arranged at a fixed position, the lower guide member being arranged so as to be opened and closed;

drive roller members for forwarding the recorded sheet along the guide members; and a sealing mechanism for sticking an adhesive tape to the cylindrically formed sheet, the guide members for guiding the sheet so as to be cylindrical having a mechanism for discharging the rolled sheet with the lower guide member opened, a swing arm for holding the lower guide member and means for driving the swing arm so that the lower guide member is opened immediately after the rolled sheet has been sealed and is then closed before a next recorded sheet is inserted into the sheet rolling unit, said means for driving the swing arm further comprising:

a wire member connected to an end of the swing arm;

a rewind pulley for rewinding the wire member;

a rachet member for holding the swing arm at an elevated position relative to the rewind pulley;

a mechanism responsive to the opening of the lower guide member for causing the ratchet member to release the elevated swing arm; and a mechanism operatively connected to the rewind pulley for returning the lower guide member to a closed position ready for sheet rolling and for rewinding the wire to return the swing arm to the elevated position.

9. A recording sheet processing unit for an image forming apparatus with means for producing either a rolled or an unrolled recorded sheet, the recording sheet processing unit including a copying machine, a post-processing unit, and a discharge tray, and further comprising:

a sheet forward path connected to a discharge path of the copying machine, the sheet forward path including guide members extending into a sheet rolling unit for directing the recorded sheet;

the sheet rolling unit, being connected to the sheet forward path, for receiving a directed recorded sheet at times when the recorded sheet is to be rolled, and for rolling the recorded sheet into a cylindrical form;

a gate member having a gate arm positioned at an input of the sheet rolling unit, being selectively movable between first, second, and third positions for directing a recorded sheet, wherein, in the first position, the gate arm and the guide members are operative to direct the recorded sheet into the sheet rolling unit, in the second position, the gate arm, the guide members, and a pushing arm disposed on the gate member, are operative to push the rolled recorded sheet toward the discharge tray, and, in the third position, the gate member and the guide members are operative to act as a sheet guide path for direct discharge of unrolled sheets; and a labeler operative to seal the recorded sheet after it is rolled.

10. A recorded sheet processing unit for an image forming apparatus according to claim 9, wherein the recorded sheet has a front side and a back side, the recorded sheet unit comprising a swingable discharge guide positioned between said post-processing unit and said discharge tray, said discharge guide being selectively moveable between first and second positions, so that, in the first position, the discharge guide is operative to guide the recorded sheet toward the discharge tray from the discharge path with the front facing up, and, in the second position, is operative to block the discharge path and guide the recorded sheet toward the discharge tray face down.

11. A recorded sheet processing unit for an image forming apparatus according to claim 9, wherein said guide members include an upper guide member and a lower guide member, the upper guide member and the lower guide member being configured to provide an arcuate path therebetween, the upper guide member being arranged at a fixed position and the lower guide member being movable between opened and closed positions, wherein, said gate member, in the third position and the lower guide member in the closed position, form a sheet guide path for directly discharging the recorded sheet, and said gate member, in the second position and the lower guide member in the open position, discharge a rolled sheet out of the sheet rolling unit.

* * * * *